2/17/81 XR 4,250,671

United States Patent [19]

Hirsch et al.

[11] 4,250,671

[45] Feb. 17, 1981

[54] ANTI-SEISMIC CONSTRUCTIONS, IN PARTICULAR CONSTRUCTIONS WITH BASEMENTS FORMING ANTI-ATOMIC SHELTERS

[76] Inventors: Jean-Raphaël Hirsch, Le Moulin des Roches, Les Mousseaux Par Ponchartrain; Claude Di Crescenzo, 32 bis Rue de Clocheville, 37000 Tours, both of France

[21] Appl. No.: 944,739

[22] Filed: Sep. 22, 1978

[30] Foreign Application Priority Data

Sep. 22, 1977 [FR] France ..... 77 28622

[51] Int. Cl.[2] ..... E02D 27/34; E04B 1/98

[52] U.S. Cl. ..... 52/167; 52/98; 52/169.6; 52/396; 52/236.3; 109/15

[58] Field of Search ..... 52/167, 169.6, 98, 100, 52/393, 396, 403, 236.3; 109/15

[56] References Cited

U.S. PATENT DOCUMENTS

| | | | |
|---|---|---|---|
| 2,271,079 | 1/1942 | Kieser | 52/98 |
| 2,358,143 | 9/1944 | Castor | 109/15 |
| 3,099,110 | 7/1963 | Spaight | 109/15 |
| 3,464,374 | 9/1969 | Basler et al. | 109/15 |
| 3,709,168 | 1/1973 | Ludwig | 109/15 |
| 3,908,323 | 9/1975 | Stout | 52/100 |
| 4,102,097 | 7/1978 | Zalotay | 52/167 |

FOREIGN PATENT DOCUMENTS

| | | | |
|---|---|---|---|
| 1264737 | 3/1968 | Fed. Rep. of Germany | 52/169.6 |
| 2557043 | 9/1978 | Fed. Rep. of Germany | 52/167 |
| 496592 | 12/1938 | United Kingdom | 52/167 |
| 520326 | 4/1940 | United Kingdom | 109/15 |

*Primary Examiner*—J. Karl Bell

*Attorney, Agent, or Firm*—Young & Thompson

[57] ABSTRACT

The present invention relates to anti-seismic constructions, in particular constructions with a basement forming anti-atomic shelters. In this type of construction, the buried basement of the construction is formed of a plurality of independent elements (3, 10) having a mechanical strength such that each of them is capable of resisting without damage the seismic waves of maximum intensity.

These constructions are used as anti-atomic shelters.

7 Claims, 2 Drawing Figures

25
27
26
14
13
12
12
29
28
8
5'
7
6
9
10
12
11
12

ANTI-SEISMIC CONSTRUCTIONS, IN PARTICULAR CONSTRUCTIONS WITH BASEMENTS FORMING ANTI-ATOMIC SHELTERS

The present invention relates to the construction of buildings likely to be subjected to earth tremors of natural origin or caused by nuclear explosions.

It is generally known how to reinforce the basements of existing buildings in order to transform them into shelters for protection against shells and explosive bombs of conventional type. In such a case, the shelter should resist the perforative power of the missile and the shakings of the ground caused by the explosions. However, such phenomena correspond to a relatively small quantity of released energy and, apart from the case of direct impacts on the shelter or in its immediate vicinity, the disturbances which may occur in the shelter structure such as cracks do not endanger the life of the occupants.

The situation is entirely different in the case of anti-atomic shelters since the nuclear arms having an incomparably higher power act at distances from the point of impact corresponding to several kilometers via various phenomena against which the users of the shelter have to be protected. Such phenomena are an atmospheric overpressure wave resulting in a violent blast of the cyclone type, a seismic pressure wave, a pure calorific and radioactive type radiation and radioactive fallouts. The users have also to be protected against derived phenomena, notably the fires lit by the calorific radiations, the missiles, the debris and dusts resulting from the atmospheric overpressure wave, the gas emanations caused by the destruction of the town mains, and even gases or biological agents used for poisoning the bombed area, and finally the eventual floods.

As a matter of fact, the shelter should therefore offer a mechanical strength far superior to standard shelters in order to notably resist the seismic pressure wave, since any crack impairs the tightness which is necessary to resist pollution and the dangers resulting from the radioactive fallouts, gases, thermal effects and also waters.

It is difficult to design an anti-atomic shelter as a superstructure as it has to resist by itself and in all its parts the atmospheric overpressure wave and it has to be monolithic, which is the cause of an expensive construction and of an inaesthetic architectural appearance. It may be buried away from any construction but, on the one hand, it is often difficult to find a site, and on the other hand the shelter has to be occupied almost permanently due to its necessary remoteness from housing areas and working sites, and finally buildings erected as superstructures over the shelter form, mainly when they are in reinforced concrete, primary screens against conventional bombs and shells. On the other hand, they create a risk of collapsing over the shelter and of starting a fire which may develop over the latter.

It is therefore essential that the buried anti-atomic shelter should perfectly resist the seismic pressure waves generated by the bomb. According to the distance of the point of impact, the determining phenomenon for the collapse of the superstructures may be the atmospheric overpressure wave, or the seismic wave acting on the foundations and eventually shaking the whole construction. In the case of an earth tremor, it is the seismic wave which causes the building to shake and collapse.

The object of the present invention is to provide constructions in which the buried part may resist intense earth tremors of natural or atomic origin, without running the risk of heavy damage, the horizontal displacements to which the buried part of the construction may be subjected not being transmitted to the superstructure.

According to the invention, the buried basement of the construction is made of a plurality of independent elements having a mechanical strength such that each of said elements is able to resist without damage the seismic wave of maximum intensity and to support an important fraction preferably exceeding a third of the weight of the superstructure, the superstructure being calculated to resist in the case where it is isostatically supported on three fulcrums distributed in a random manner amongst its fulcrums foreseen for the construction on the elements of the sub-foundation, the shearing strength of the connections at the superstructure fulcrums on the elements of the sub-foundation elements being lower than the global shearing strength of the structure elements leading to the point in consideration.

With this embodiment, the elements of the sub-foundation may under the effect of seismic waves be subjected to relative displacements without that any stress, notably a shearing stress, superior to the mechanical strength of the superstructure be transmitted to the latter.

A dislocation of the sub-foundations into their independent elements may result in the superstructure resting on three only of said elements ensuring an isostatic support, but without dislocation of the superstructure and thus sheltering the occupants from any possible sagging and allowing to subsequently underpin, for instance by grouting, in order to re-level the sub-foundations.

Preferably, and according to another characteristic of the invention the independent elements of the sub-foundation are formed in part at least of cells fit for habitation and constituting anti-atomic shelters.

According to a further characteristic, the independent elements are separated from each other over a distance at least equal to the compressibility of the thickness of ground equal and parallel to their larger horizontal dimension under the maximum pressure developed by the seismic wave of maximum intensity.

The interval between two independent elements is, particularly in the case of cells fit for habitation, filled up by a compressible material as tight as possible to water, gases and radiations. Such a material which can be put out of shape may be a foam incorporating a heavy metal filler or a composite material with a foam base and malleable metal layers.

According to a further characteristic, the elements of the subfoundation are situated at a distance from the vertical wall elements delimiting the foundation pit, with the interval filled with an impervious compressible material.

It is usual to provide the access to the anti-atomic shelters with airtight locks-chambers, and such locks-chambers are eventually provided for giving access to the cells or the group of cells. However, the normal entrances situated under the superstructure may be blanked off if the superstructure collapses under the effect of the atmospheric overpressure wave. In order to remedy such a disadvantage, there has already been proposed, for instance in French Pat. No. 1,375,468 registered on Nov. 22, 1963, to provide the anti-aircraft shelters with emergency exits formed by an underground trench connecting said shelter to a shaft dug in the ground. It is known that such an exit shaft should be situated at a distance from the building which is at least equal to the height of said building and the above mentioned patent proposes to provide the entrance and various points of the trench with isolation doors. However, it is sure that such a trench, when subjected to an intense earth tremor, may collapse and that metallic doors may get jammed. Where the present invention is being developed, the emergency exit is formed of tubular elements which are individually capable of resisting without being crushed the earth tremor of maximum intensity, the various elements being connected to each other by flexible seam joints capable of absorbing the relative displacements of two successive elements. According to an embodiment, the extremities of two successive tubular elements, separated by a distance sufficient for absorbing the relative displacement, are engaged in a junction tubular element offering the same characteristics of mechanical strength, but preserving between its inner surface and the outer peripheral surface of the inner elements a clearance which is superior to the relative displacement, said clearance being filled with a material which can be put out of shape similar to that used between the elements of the subfoundation.

According to a further characteristic, the access to the emergency exit is blanked off by a rigid wall which may be destroyed with tools available in the shelter, for instance a wall made of brick-work, of non re-inforced concrete or any similar material.

The present invention will now become more apparent from the following detailed description of one embodiment thereof when taken in conjunction with the accompanying drawings wherein.

Figure 1:
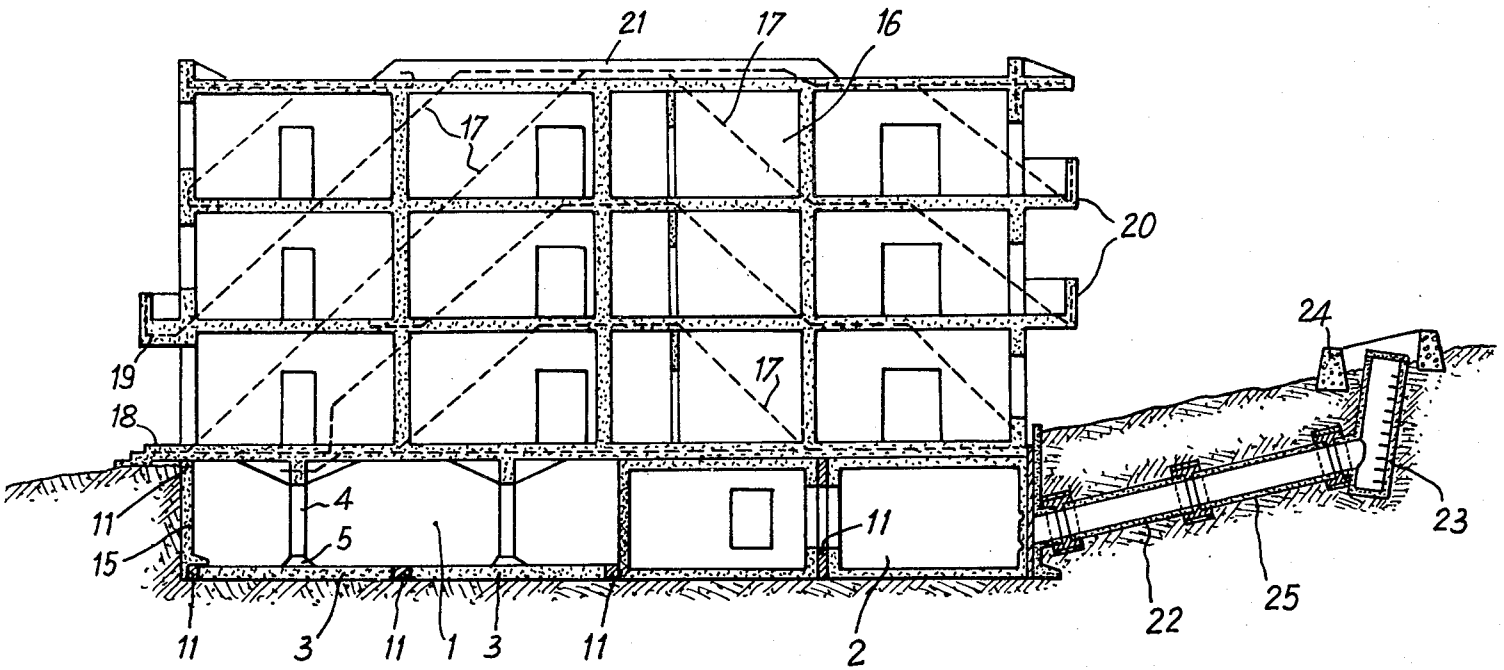
FIG. 1 is a schematic vertical cross sectional view of a building according to the invention.
Figure 2:
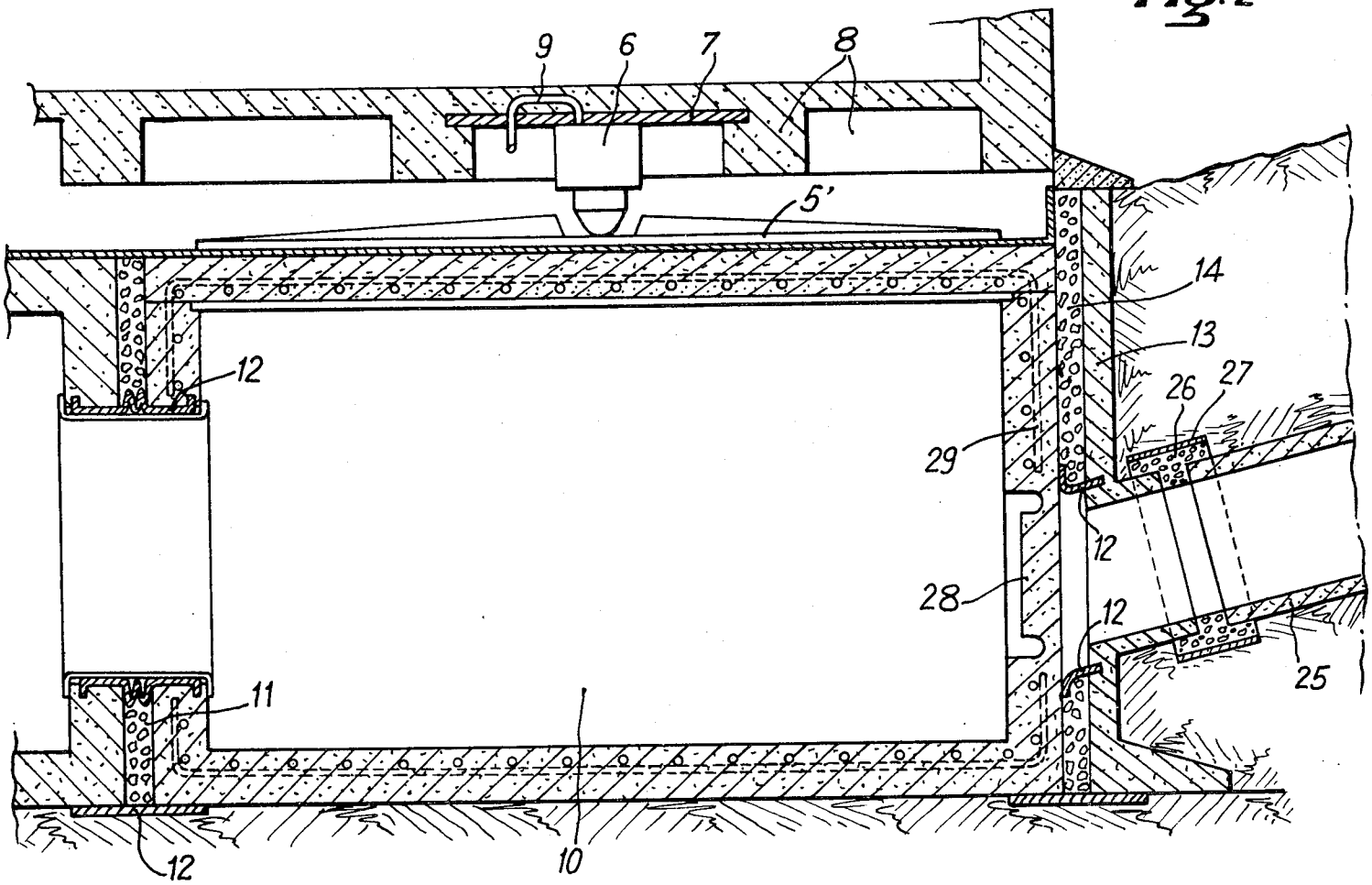
FIG. 2 is a detailed view of part of the cell connected to the emergency exist.

In the embodiment shown in the drawings, the invention is applied to a two-storeyed building. The buried sub-foundation is only one storey deep and comprises a part 1 forming garages and a part 2 forming an anti-atomic shelter. Part 1 comprises a number of reinforced concrete slabs with a thickness and a steel reinforcement sufficient for supporting each an important fraction which may theoretically reach the third of the total weight of the construction, concentrated in their center. In order to increase their strength, these slabs may be shaped and contain beams forming a crossed network. The building bears on slabs 3 via posts 4 provided with distribution sole-pieces 5. The distribution sole-piece 5 is not solid with slab 3, except eventually via small section steels capable of being sheared when shear stresses are exerted which exceed the shearing strength of post 4. In the case of a construction in a particularly exposed area or of a construction of a particular nature, the destruction of which might be the cause of great danger, for instance central nuclear stations, there might be provided a connection with vertical resiliency between each slab 3 and each post 4. An optimum solution would consist in a construction of the completely isostatic type wherein each support between the building and the sub-foundation comprises, as is shown in FIG. 2, a jack 6 interposed with a swivel system between each slab 5 and each post 4 or between a repartition metallic sole-piece 5' bearing on a habitable cell 10 forming an anti-nuclear shelter as described hereafter and a support plate 7 embedded in the system of support beams 8 of the superstructure building. The jacks 6 are distributed in three groups and the jacks of the same group are interconnected by a duct 9. Each jack or group of jacks may be connected to an absorption chamber for the pressure waves in the form of a hydro-pneumatic chamber or similar which is not shown. With this embodiment, a vertical wave which propagates under the elements with a vertical amplitude inferior to the stroke of the jacks may be absorbed without damaging the construction.

Part 2 is formed by habitable cells also in re-inforced concrete 10. Such cells are individually calculated so as to support, as slabs 3, an important fraction of the weight of the construction and to be capable of resisting the compression caused by the seismic waves which are applied on their side faces. It should be noted that when there is provided systems of distributing jacks 6, the weight of the construction is always distributed between the various supports and the fraction of the weight of the building which each support has to bear is therefore low. These cells are equipped as all standard antinuclear shelters with the standardized emergency equipment as regards survival means, ventilation, light and disinfection. They may serve directly as support, without mechanical connection preventing a horizontal displacement or limiting it beyond a certain shearing strength, for the superstructure construction. This support may also comprise a hydrostatic connecting device as is shown in FIG. 2.

Generally, and according to the invention, the sub-foundation elements, slabs 3 and cells 10, are separated by a distance which is approximately equal to the maximum amplitude of the displacement which may receive the element under the effect of a natural or atomic earth tremor. The interval thus created is supplied with a seam joint 11 made of a tight material capable of being resiliently deformed which may be a plastic foam with heavy metal salts as a filler. This seam joint may, as is shown in FIG. 2, be delimited or subdivided by lead or similar partition sheets 12 which may be corrugated and anchored in the adjoining elements. The plastic foam of the seam joint which has to have elongation and compression coefficients as high as possible, is preferably casted on the site and anchoring recesses for the foam (not shown) may be foreseen in the surfaces of the adjoining pieces, so that even stretched, the foam may continue to provide tightness.

In order to reduce as much as possible the transmission of the seismic waves to the sub-foundation elements, the side walls of cells 10 facing the ground may be doubled by walls 13 with an in-between space filled with foam 14 treated as the foam of seam joints 11. The side walls 15 of the other basements are preferably mounted also floating with seam joints 11 at the base and top. The tightness to water, gases and radiations of the seam joints which are not pertaining to part 2 forming the anti-nuclear shelter may be neglected and said joints may be simple overlapping joints likely to be sheared under the stresses resulting from an earth tremor.

The superstructure construction 16 is built as a self-supporting element, made specially when the load is directly transferred, that is without connections of the jacks 6 type, on elements 3 and 10 of the sub-foundation. For so doing, the lattice-work reinforcements 17 are embedded in the rammed concrete partition walls arranged in the two orthogonal orientations. The architectural elements such as the thresholds 18, the frontons 19, the balconies 20 and others are calculated as binding elements and reinforced accordingly. In order to increase the moment of inertia and the breaking strength along a medium plane, beams such as in 21 in which is embedded part of the lattice-work reinforcement may be arranged as a chequer work on the terrace.

Those of cells 10 which are close to the ground may comprise emergency exits leading via a buried duct 22 to an exit shaft 23 situated at a distance from building 16 which is substantially equal to the height of said building in order to avoid that its exit be blanked off by the collapsed parts. In this embodiment, the exit is surrounded by a concrete annular construction forming a barrage against running waters. Duct 22 is made of elements such as centrifuged reinforced concrete ducts 25 capable of resisting the seismic waves. The connections between the elements are made of foam rings 26 with thicknesses sufficient for absorbing the relative displacements. Such rings are maintained in position by metallic collars 27. The access to duct 22 may be provided by destroying with the tools available in the shelter a thinned portion 28 of the partition wall opposite cell 10, the reinforcement 29 being also interrupted in the vicinity of said thinned portion.

The above described embodiments may receive many modifications without departing from the scope of the present invention.

What we claim is:

1. A construction liable to be subjected to seismic waves comprising a superstructure and buried sub-foundation elements forming anti-atomic shelters in which the buried sub-foundation elements comprise at least three independent elements having a mechanical strength such that each of them is capable of resisting without damage the seismic wave of maximum intensity and to sustain at least a third of the weight of the superstructure, the superstructure resting on the sub-foundation elements through fulcrums and being mechanically resistant when isostatically supported on three non-aligned fulcrums distributed in a random manner amongst said fulcrums, the shearing stress of the connections at the superstructure fulcrums on the elements being lower than the global shearing stress of the structure elements leading to said fulcrum, each sub-foundation element having a mechanical strength such that it is capable of resisting without damage the seismic wave of maximum intensity and any two of said sub-foundation elements being spaced from each other a distance at least equal to the compressibility of a thickness of ground equal and parallel to their larger horizontal dimension under the maximum pressure developed by said seismic wave of maximum intensity.

2. An anti-seismic construction according to claim 1 in which at least one of the sub-foundation element is a habitable cell forming an atomic bomb shelter.

3. An anti-seismic construction according to claim 1 in which the space between two sub-foundation elements is filled with a compressible material impervious to water, gases and radiations.

4. An anti-seismic construction according to claim 1 in which the sub-foundation elements are spaced apart from the vertical wall elements delimiting the sub-foundation excavation, the in-between interval being filled with an impervious compressible material.

5. An anti-seismic construction according to claim 1 having an emergency exit comprising a buried duct from the habitable cells and which is formed of tubular elements, the various elements being connected to teach other by flexible seam joints capable of absorbing the relative displacement of two successive elements under the seismic wave of maximum intensity.

6. An anti-seismic construction according to claim 5 in which the extremities of two successive tubular elements spaced apart a distance sufficient for absorbing the relative displacement, are engaged into a junction tubular element preserving between its inner surface and the peripheral outer surface of the inner elements a clearance greater than said relative displacement, said clearance being filled with a material capable of being deformed.

7. An anti-seismic construction according to claim 1 in which said fulcrums comprise jacks, said jacks being distributed in three non-aligned groups, the jacks within each said group being interconnected.

* * * * *